United States Patent [19]

Larrecq et al.

[11] Patent Number: 4,562,880

[45] Date of Patent: Jan. 7, 1986

[54] PROCESS FOR ADJUSTING THE SECONDARY-COOLING RATE OF A CONTINUOUS-CASTING MACHINE

[75] Inventors: Michel Larrecq; Denis Tromp, both of Metz; Jean-Pierre Birat, Semecourt, all of France

[73] Assignee: Institut de Recherches de la Siderurgie Francaise, St.-Germain-en-Laye, France

[21] Appl. No.: 575,041

[22] Filed: Jan. 30, 1984

[30] Foreign Application Priority Data

Jan. 28, 1983 [FR] France ..... 83 01404

[51] Int. Cl.[4] ..... B22D 11/124

[52] U.S. Cl. ..... 164/455; 164/414; 164/486

[58] Field of Search ..... 164/455, 414, 486, 444, 164/485

[56] References Cited

U.S. PATENT DOCUMENTS 4,073,332 2/1978 Etienne ..... 164/486
4,463,795 8/1984 Chielens et al. ..... 164/455

FOREIGN PATENT DOCUMENTS 0036342 9/1981 European Pat. Off. .
56-33157 4/1981 Japan ..... 164/455

OTHER PUBLICATIONS

"Modele Pratique de Gestion et de Commande du Refroidissement Secondaire en Calculateur . . . " by J. Foussal published in Revue de Matellurgie—Jun. 1978.

*Primary Examiner*—Nicholas P. Godici
*Assistant Examiner*—K. F. Berg
*Attorney, Agent, or Firm*—Karl F. Ross; Herbert Dubno

[57] ABSTRACT

In regulating the flow of cooling water sprayed upon a metallurgical product such as a steel slab in a machine for the continuous casting of such products which then undergo a straightening operation, the present, past and future speeds of the product are taken into account so as to compensate a projected change in the temperature of the product in the straightening stage, due to a planned or expected modification of the cooling conditions. These conditions are established by a regulating system responsive to changes in the speed of the product; the anticipated temperature change is compensated by substituting for the true speed, as a controlling parameter, a fictitious speed lying between the true speed and an advance image of an anticipated speed change whose effects upon the temperature are to be neutralized.

6 Claims, 7 Drawing Figures

PRIOR ART

GENERAL FLOW CHART OF PROGRAM FOR CONTROLLING RATES OF WATER FLOW FOR SECONDARY COOLING

PRIOR ART

FLOW CHART OF PROGRAM FOR CALCULATING THE ZONE CONTAINING THE SLAB HEAD

WHEREIN: (1) = INCOMING ELEMENT
(2) = SLAB HEAD
(3) = BEGINNING OF ZONE
(4) = END OF ZONE

PROCESS FOR ADJUSTING THE SECONDARY-COOLING RATE OF A CONTINUOUS-CASTING MACHINE

FIELD OF THE INVENTION

Our present invention relates to a process for adjusting the rate of secondary cooling of a metallurgical product, such as a steel slab, in a continuous-casting machine with the aid of a water spray controlled to take the present and the past speed of the product into account, as is well known in the art.

BACKGROUND OF THE INVENTION

The importance of secondary cooling, as concerns not only the quality of the cast products but also the productivity of the casting machine, has long been recognized. The results to be achieved by a good regulation of the cooling rate include:

complete solidification of the product before a certain operating stage, especially at a point where a slab descending along an arcuate path is straightened before being subjected to blow-torch cutting;

good mechanical strength of the solidified skin of the product along the machine and, in particular, avoidance of swelling problems due to an excessive surface temperature which may cause significant cracks and central segregation;

a substantially even cooling of the product so as to eliminate any sudden temperature change likely to create so-called median cracks in the solidification front; and maintenance of the surface temperature during straightening in the range of good forgeability of the metal to avoid the formation of transverse cracks on the concave side of a curved slab.

Under steady operating conditions, the optimum setting of the rate of secondary cooling involves, on the one hand, a suitable distribution of the spray water along the cast product or workpiece in the several cooling zones of the machine and, on the other hand, an optimization of another parameter in direct relationship with the productivity of the machine, namely the casting speed. This optimization is satisfactorily accomplished with the present state of the art.

Under varying working conditions necessitating changes in the casting speed, however, optimization of cooling requires a controlled variation of the water-flow rates satisfying at all times, as much as possible, the above-mentioned desiderata.

Different modes of controlling the secondary cooling have already been proposed. They all use the casting speed as an active parameter for calculating the water-flow rates, but may be separated into different groups depending on the method adopted. More particularly, in a first group of methods the flow rates are determined in the different spraying zones solely as a function of the instantaneous casting speed. These methods are, generally, poorly adapted to the casting of slabs for the production of thick sheets; thus, for example, they generally do not allow, upon a sudden slowdown of the casting, the surface temperature of the slab to be maintained in a range best suited for forging products of the chosen grade.

In a second group of methods, these flow rates are determined on the basis of an average speed derived from the past and present history of the casting operation.

These methods are then based on:

(a) The definition of a parameter characterizing in each spraying zone the past and present history of the cast product. In most cases, with an elongate workpiece such as a slab conceptually divided into a succession of unit-length elements, it is a question of the average age of the element present at any time in a given zone; the age of a unit-length element is defined as the time (residence time) spent by it in the machine from its creation in the ingot mold.

(b) The choice of a spraying curve based on metallurgical criteria and indicating for each zone the flow rate of the spray water in dependence upon the value of the aforementioned parameter.

The latter method, accordingly, involves a varying water distribution among the different zones and generally requires the use of a computer because of the numerous calculations to be made so as to determine, at regular time intervals, the average age of the elements in these zones.

The methods of this group differ from one another by the choice of the spraying curves and the cooling criteria to which they conform, as well as by the mode of calculating the average age.

Reference may be made in particular to French patent application No. 80/05592 and corresponding European application 36.342, published Sept. 23, 1981, as well as to a French-language article by J. Foussal, published June 1978 in Revue de Métallurgie, pages 403–414. The system described in the French application includes a computer storing data for two families of curves, pertaining to different casting speeds, which respectively represent heat extraction and surface temperature in different irrigation zones and serve as reference parameters for the adjustment of the spray. The Foussal article discusses the calculation of the mean or average age of a workpiece element to be coated.

In all instances, the spraying curves are to be chosen so as to best attain the objectives of cooling, in particular of maintaining the surface temperature in a straightening zone above the poor-forgeability range of the cast product; in steel casting, generally, this temperature should be not less than about 900° C. for avoiding the formation of transverse cracks on the inner or concave side of a slab.

Even the most perfect conventional systems for controlling the secondary cooling still do not reliably attain this objective, mainly because of significant transitory conditions inherent in continuous casting, such as change of steel grade, replacement of pouring vessels, as well as start-up and end of casting.

This is all the more true since the last cooling zones have only limited ranges of adjustability. In general, moreover, the last zone upstream of a straightening stage is often deprived of cooling means. Also, should substantial speed variations occur, little can be done to correct the thermal profile of the part of the workpiece situated in these terminal zones. This may not be very serious if the change consists in an acceleration since in that case the temperature increases; its rise, however, should not be carried too far, because of the risks of swelling or rupture of a workpiece which is not yet completely solidified.

On the other hand, the situation may become critical should the workpiece slow down or stop as, in this instance, the temperature drops unavoidably and may fall into the poor-forgeability region, even if cooling is halted, simply through heat loss by radiation.

OBJECTS OF THE INVENTION

Thus, the object of our invention is to provide a process for regulating the cooling rate which is free of the above-mentioned drawbacks.

SUMMARY OF THE INVENTION

We realize this object, within the framework of a process of the type discussed hereinabove, by taking not only the present and past speeds of the workpiece into account but also its future speed so as to compensate in advance a change in the temperature of the workpiece at a given operating point, specifically in a straightening stage, resulting from a planned or expected modification of its speed.

More specifically, with use of a regulating system responsive to the actual casting speed of the workpiece, the change in temperature at the straightening stage may be compensated in advance by temporarily feeding into that system, instead of the actual or real-time speed, a fictitious speed lying between the real-time speed and an anticipated future speed whose effects on the temperature are to be neutralized.

In other words, a phantom or fictitious parameter is introduced into the regulating system.

Our invention is partly based on the analysis of situations encountered in the continuous-casting procedure, this analysis showing that about 90% of the events are foreseeable; thus, for example, a change of the pouring basket or tundish resulting in a supply interruption may be scheduled, say, half an hour in advance. Accordingly, the subsequent cooling of the workpiece in the final zone following a slowdown may be anticipated and compensated by prior overheating (with respect to the normal operating conditions) through a reduction of the cooling effect.

BRIEF DESCRIPTION OF THE DRAWING

The above and other features of our invention will now be described in detail with reference to the accompanying drawing in which.

SPECIFIC DESCRIPTION

Figure 1:
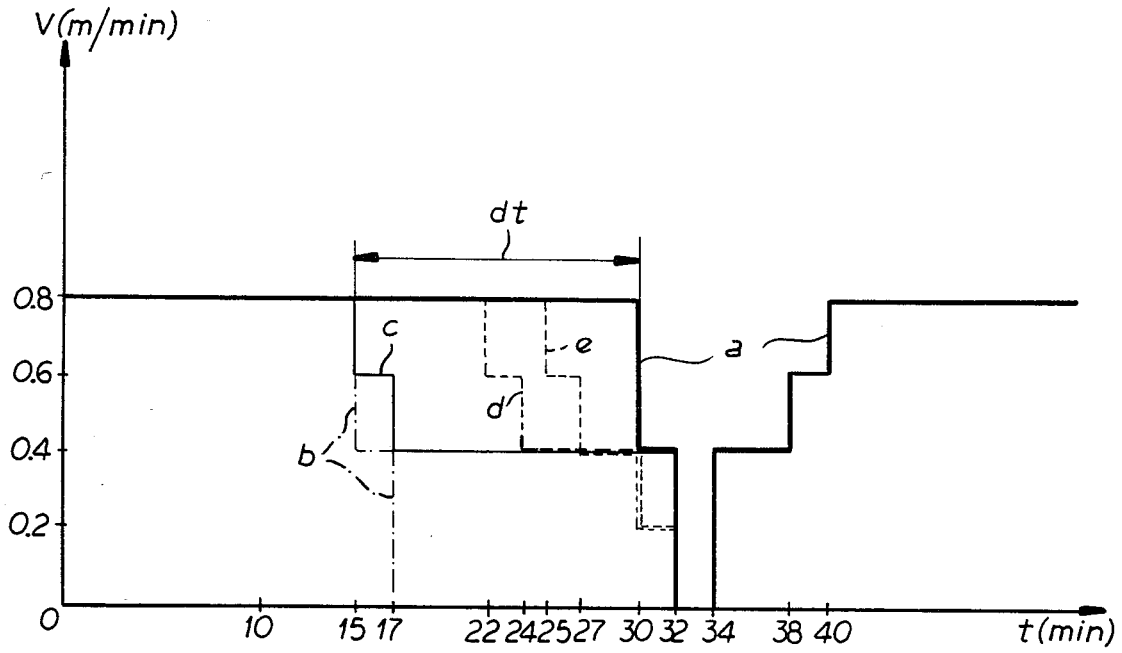
FIG. 1 is a graph of real-time and fictitious casting-speed profiles.

In FIG. 1 we have shown variations of casting speed V (in meters per minute), as a function of time t, in a steel-casting plant to which our invention is applicable. Instant t=0 is a reference time during steady-state operation assumed to precede by half an hour a planned event, e.g. a change of pouring basket or tundish, causing a speed modification. Heavy-line curve a represents actual slab speed $V_a$, dropping from a steady value of V=0.8 meters per minute to 0.4 m/min at t=30 min and to V=0 at t=32 min; at t=34 the speed is again 0.4 m/min, rising to 0.6 m/min at t=38 and regaining its steady value at t=40.

Whereas in a conventional cooling-control system this actual or real-time speed is taken as a regulating parameter, our invention uses an anticipated fictitious speed $V_f$, such as one represented by a curve c, d or e and more fully discussed hereinafter, depending on the chosen or expected degree of impending speed change, which is fed into the system. The events are not, in fact, all foreseeable with the same lead time. Moreover, even though they may be predictable long in advance, their arrival does not necessarily occur at the anticipated time; as a general but not indispensable rule, the maximum lead time compatible with the entirety of the metallurgical requirements of the casting is adopted. Thus, we avoid compensation too far ahead which could cause a temperature drop beyond the acceptable threshold on the workpiece surface at the straightening stage or along the slab.

The anticipated speed profile is not necessarily identical with the true speed profile at the time of the event since, even if the event itself is preprogrammed or otherwise foreseeable, the exact speed profile is not invariably known accurately beforehand; however, the use of a forwardly projected image of curve a (such as one represented by a phantom-line curve b) in determining the fictitious speed—as more fully described below—generally yields satisfactory results.

Figure 2:
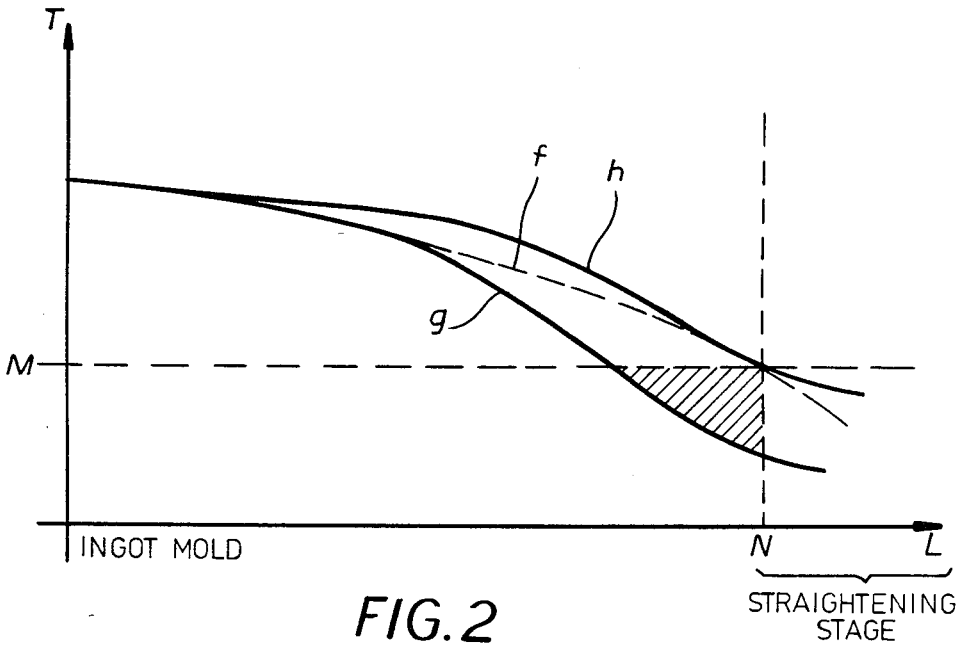
FIG. 2 is a graph of temperature variation as a function of the progression of a given unit-length element of a steel slab, with respective curves for three cases, namely, ideal, modified by an event, and corrected by anticipation in accordance with the invention.

FIG. 2 shows, as a function of the location L of an element along the casting length of a workpiece, the variations of the temperature T of that element. The dashed curve f represents the ideal temperature profile with the temperature decreasing from a maximum value at the outlet of the ingot mold to a value corresponding to the forgeability threshold M, generally about 900° C., at a straightening point N. In the system described hereinafter with reference to FIG. 7, an element leaving the mold outlet reaches point N after about 23.5 minutes of travel at speed $V_a$=0.8 m/min.

Solid curve g represents the profile of the temperature when an event occurs which is characterized by a drop in the casting speed. This event disturbs the regulation and causes the surface temperature to drop below the forgeability theshold, particularly at the straightening point N. Such a drop matters little in the region where the steel is still flowable, since there the heat regulation operates fairly well, but creates difficulties—as noted above—in the region of the last elements downstream of the point of complete solidification of the workpiece.

Curve h represents the profile obtained by the process of our invention whereby, through utilization of an anticipated fictitious speed profile (as shown in FIG. 1) fed into the computer as a flow-controlling parameter, we are able to maintain the workpiece temperature above the forgeability threshold M up to the straightening point N.

Figure 3:
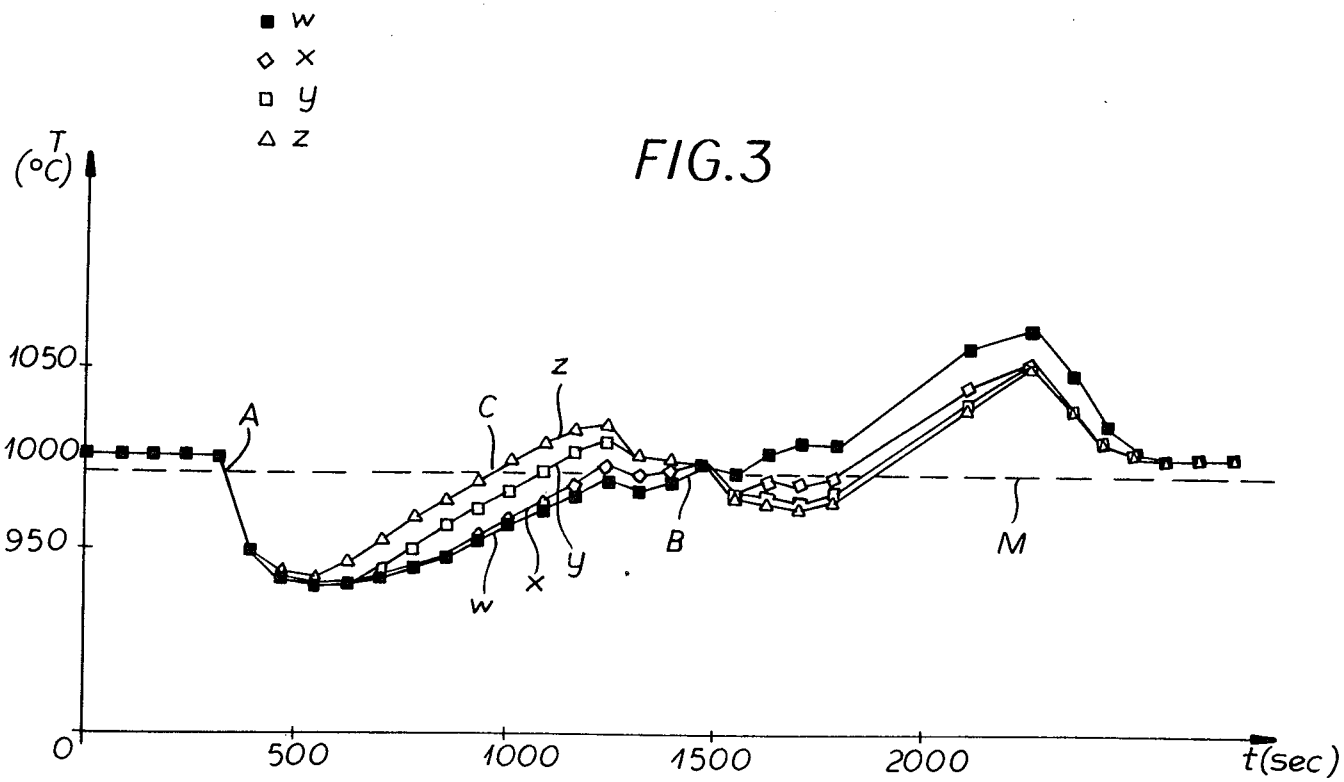
FIG. 3 is a graph of the temperature variation of the slab at a straightening stage for elements successively arriving there.

FIG. 3 shows four curves representing surface temperatures of a slab in the area of the straightening stage for elements that have left the ingot mold at times t (in seconds), measured from the reference time t=0 of FIG. 1. Curve w gives the progressive temperature variations in a conventional system for controlling the cooling rate on the basis of real-time speed profile a (FIG. 1), as discussed with reference to curve g of FIG.

2; curves x, y, z correspond to the temperature changes imposed in accordance with our invention by anticipating an advancement-slowing event such as a tundish replacement according to the fictitious speed profiles e, d, c, respectively, of FIG. 1.

In all four instances, with the event starting at t=1800 in FIG. 3 pursuant to the assumptions made in connection with FIG. 1, workpiece elements leaving the ingot mold during the first 300 seconds of the time scale of FIG. 3 will arrive at the point N of FIG. 2 about 1400 seconds later and thus before the speed change due to the tundish replacement. Their surface temperatures, therefore, will have the steady-state value—here of 1000° C.—lying above the threshold M of poor forgeability.

A point A, common to all the curves, marks the beginning slowdown and subsequent stoppage of the slab occurring between the $30^{th}$ and the $32^{nd}$ minute in FIG. 1. Curve w indicates the resulting temperature drop in the straightening zone for all elements leaving the mold 400 or more seconds after time t=0, that temperature regaining the threshold M only at a point B with slab elements leaving about 1000 seconds later. This means that, with the conventional irrigation control based on actual or real-time speed $V_a$, a significant length of slab will undergo straightening at temperatures below those considered necessary for satisfactory operation.

Curves x, y and z, given only for times beyond point A, indicate significantly shorter temperature drops below level M. Curve z, based on a fictitious speed $V_f$ conforming to curve c of FIG. 1, shows a threshold crossing at a point C near t=1000, pertaining to elements leaving the mold about 10 minutes after those first subjected to the temperature drop. According to FIG. 1, the slab advances a total of only about 5 meters during this time interval.

Curve z, while being the optimum among those illustrated in FIG. 3, does not necessarily represent the best solution in terms of the instructions to be emitted by the computer of the cooling system in response to fictitious speed $V_f$. Such instructions, translated into water-flow rates at irrigation zones numbered 1 through 6 in FIG. 7, appear in the following Table:

| | Flow Rates (in $m^3$/hour) | | | | | | | | | | | | | |
|---|---|---|---|---|---|---|---|---|---|---|---|---|---|---|
| | Time (min) | | | | | | | | | | | | | |
| Zone | 10 | 15 | 20 | 25 | 28 | 30 | 32 | 34 | 36 | 38 | 40 | 45 | 50 | 55 |
| 1 | 10 | 10 | 10 | 10 | 10 | 3.6 | 0 | 3.6 | 3.6 | 3.6 | 10 | 10 | 10 | 10 |
| 2 | 6.2 | 6.2 | 6.2 | 6.2 | 6.2 | 2.2 | 1.8 | 1.8 | 1.8 | 1.8 | 6.2 | 6.2 | 6.2 | 6.2 |
| 3 | 8.1 | (8.1) | (8.1) | (8.1) | (8.1) | (4.5) | 3.9 | 3.9 | 3.9 | 3.9 | 4.0 | 8.1 | 8.1 | 8.1 |
| | | 4.5 | 3.9 | 3.9 | 3.9 | 3.9 | | | | | | | | |
| 4 | 10.3 | (10.3) | (10.3) | (10.3) | (10.3) | (7.2) | 2.4 | 2.4 | 2.4 | 2.4 | 2.4 | 9.4 | 10.3 | 10.3 |
| | | 8.8 | 2.4 | 2.4 | 2.4 | 2.4 | | | | | | | | |
| 5 | 5.0 | (5.0) | (5.0) | (5.0) | (5.0) | (3.6) | 1.5 | 1.5 | 1.5 | 1.5 | 1.5 | 1.5 | 4.5 | 5.0 |
| | | 4.3 | 1.5 | 1.5 | 1.5 | 1.5 | | | | | | | | |
| 6 | 0 | 0 | 0 | 0 | 0 | 0 | 0 | 0 | 0 | 0 | 0 | 0 | 0 | 0 |
| $V_a$ (m/min) | | | 0.8 | | | 0.4 | 0 | 0.4 | 0.4 | 0.6 | | | 0.8 | |
| $V_f$ (m/mn) | 0.8 | 0.6 | | 0.4 | | 0.2 | 0 | 0.4 | 0.4 | 0.6 | | | 0.8 | |
| | | | | | | tundish replacement | | | | | | | | |

The times given at the top and the speeds $V_a$, $V_f$ given at the bottom of the foregoing Table correspond to times t and curves a, c in FIG. 1. For times of 15 through 30 minutes and zones 3–5, values in parentheses represent irrigation rates in a conventional system taking only speed $V_a$ into account while those without parentheses are for a system operating in accordance with our present method, anticipating a speed-reducing event with a lead time of 15 minutes in this example. In all other instances the two sets of values are identical for both systems. The slab is not being sprayed in zone 6, as indicated by a flow rate of 0.

A comparison between the conventional values and those provided in accordance with our invention shows that the prior-art flow rates remain constant up to the instant of speed reduction (t=30) in all zones whereas the present method, on the basis of the aforementioned lead time, diminishes the rates in zones 3, 4 and 5 beginning at t=15. At the instance of actual slowdown (t=30) the prior-art rates undergo only a partial reduction whereas ours are already at a low value, reached 10 minutes earlier, which is to be maintained up to the resumption of normal speed at t=40.

According to FIG. 1, the curve c determining the fictitious speed $V_f$ represents the arithmetic mean between real-time curve a and image curve b which corresponds to the descending branch of curve a advanced by the lead time dt of 15 minutes; the ascending branch of curve a (beginning with t=34) is disregarded. Curve c, starting like curve b at t=15 and ending at t=32, merges with curves d and e which have the same shape but start at t=22 and t=25, respectively. These two latter curves are thus based on lead times of 8 and 5 minutes, respectively, and on image curves lying between curves a and b.

Whereas curves c, d and e represent fictitious speeds given by $(V_a+V_b)/2$ where $V_b$ is an anticipated speed corresponding to the respective image curve, we may use fictitious speeds given more generally by $V_f=\alpha V_a+\beta V_b$ where $\alpha$ and $\beta$ are fractions adding up to 1. This, of course, can also be expressed by $V_a>V_f>V_b$.

With the disappearance of $V_f$ at t=32 in the example given, the computer operates thereafter on the actual speed $V_a$ until the next speed reduction is anticipated within lead time dt. This mode of operation will be satisfactory in many situations; it should be noted, however, that the curves of FIG. 3 represent in their right-hand portions (beyond point B) a case where an anticipated speed increase above the normal value of $V_a$ results in a lower degree of overheating with our present method (curves x, y, z) than with a conventional control system (curve w).

Figure 4:
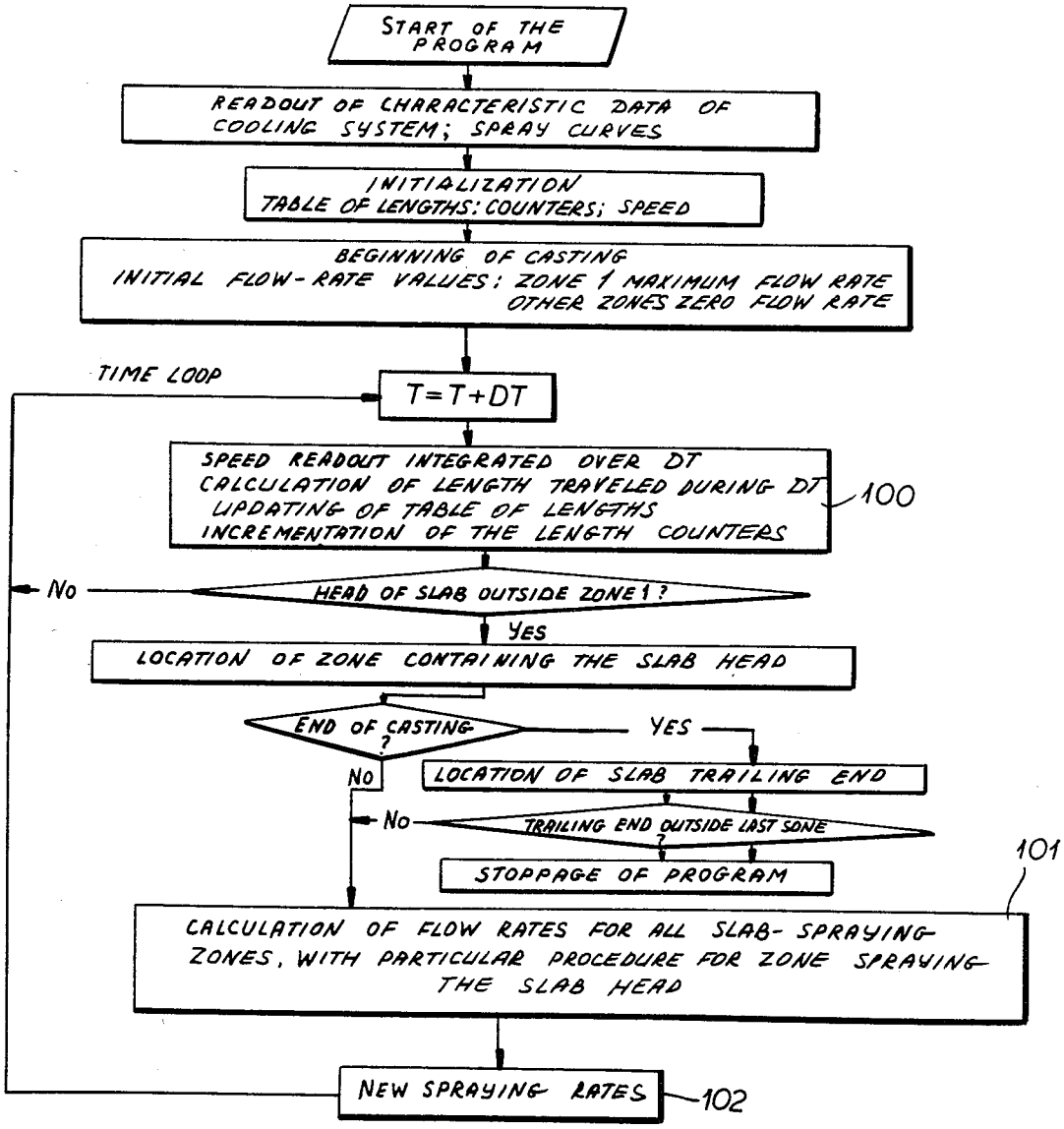
FIGS. 4–6 are flow charts of a computer program controlling the irrigation of the slab in a series of secondary-cooling zones.
Figure 5:
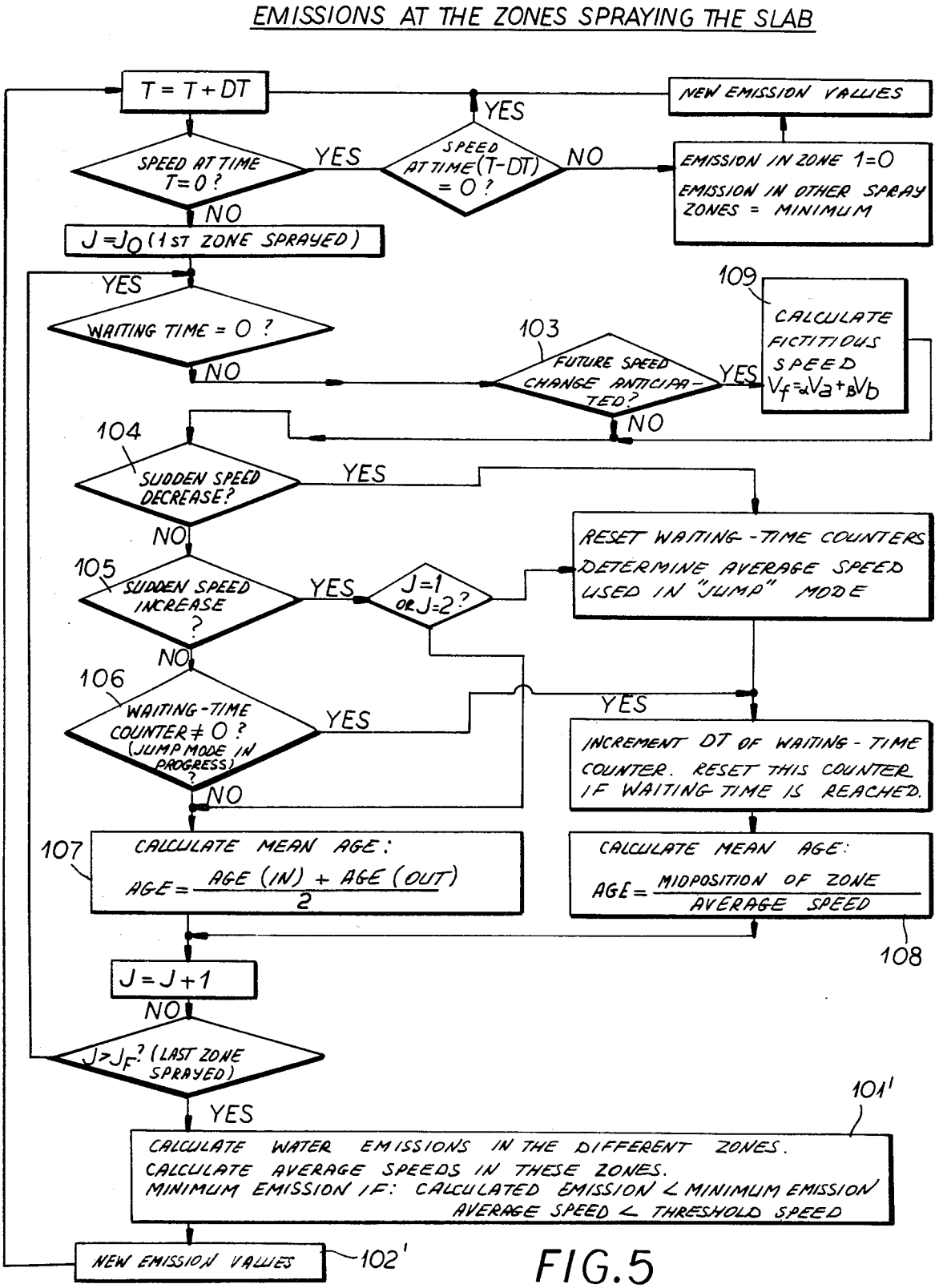
Figure 6:
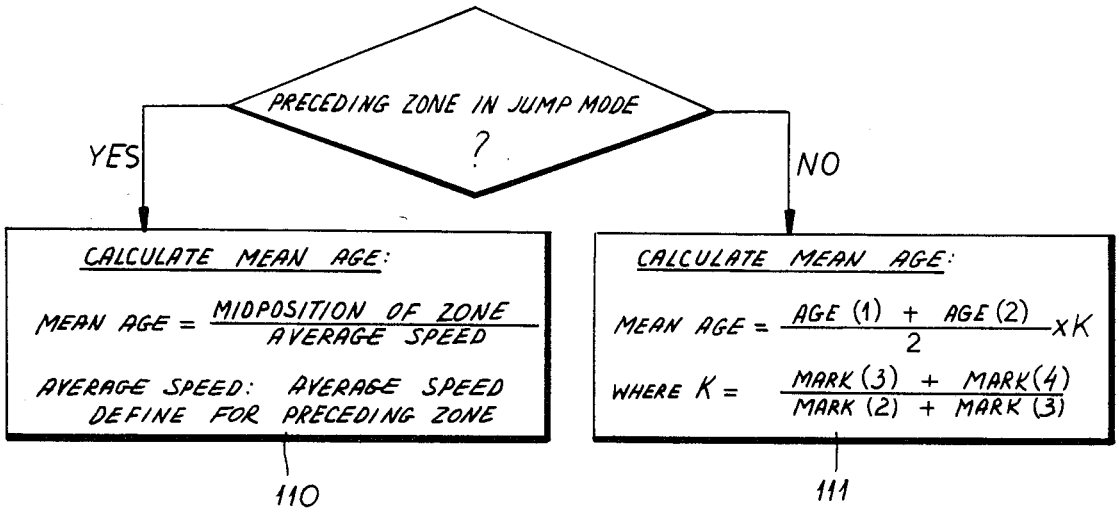

The computer program used for implementing the process of our invention conforms to the flow charts of FIGS. 4–6. FIG. 4 shows the overall routine applicable to both the conventional method (e.g. as described in the above-identified Foussal article) and to the method of our invention. The difference between the two methods resides in the utilization, in a step 100, of the fictitious speed $V_f$ read out from a calculating unit, at certain times in the operation as described above, instead of the actual speed $V_a$ supplied by a speed sensor (such as a pulse generator described in the French patent application referred to). After initialization, i.e. during steady-state operation, these speeds are utilized in a step 101 to calculate the flow rates required in any operating cycle (e.g. of 10 seconds) for which those rates have to be redetermined. Any necessary resetting of throttle valves controlling the water supply to the spray nozzles of each active zone then takes place in a step 102. The remaining steps and inquires are considered self-explanatory.

A subprogram implementing steps 101 and 102 in FIG. 4 is shown in FIG. 5. An inquiry 103 ascertains from data initially stored or fed in during preceding cycles whether a future speed change is anticipated within the lead time dt discussed above. If not, the computer checks in two further inquiries 104 and 105 whether the actual speed $V_a$ has significantly decreased or increased in the current operating cycle and in that case initiates at 106 certain calculations—known per se from the Foussal article—to determine, in steps 107 and 108, the mean age of the slab element to be irrigated in a given zone. This determination takes both present and past speeds into account. Subsequent steps 101' and 102' are parts of steps 101 and 102 (FIG. 4) pertaining to steady-state operation.

If inquiry 103 has an affirmative outcome, it leads to a subroutine 109 which calculates the fictitious speed $V_f = \alpha V_a + \beta V_b$ (e.g. with $\alpha = \beta = 0.5$) to be used in lieu of actual speed $V_a$ in the subsequent inquiries. With the mode of operation more particularly described above, speed $V_f$ undergoes no sudden increases so that inquiry 106 will yield a positive result only after $V_f$ has again been replaced by $V_a$.

FIG. 6 applies to the initialization phase and shows the particular procedure for calculating the flow rate of the zone containing the slab head, according to step 101 of FIG. 4. These calculations, known per se and given only for the sake of completeness, are represented by two steps 110 and 111. Step 110 will generally be based on present and past values of actual speed $V_a$ presumed to remain substantially constant during that phase. The term "Mark" in step 111 signifies distance from a point of reference, such as the outlet of the ingot mold.

Figure 7:
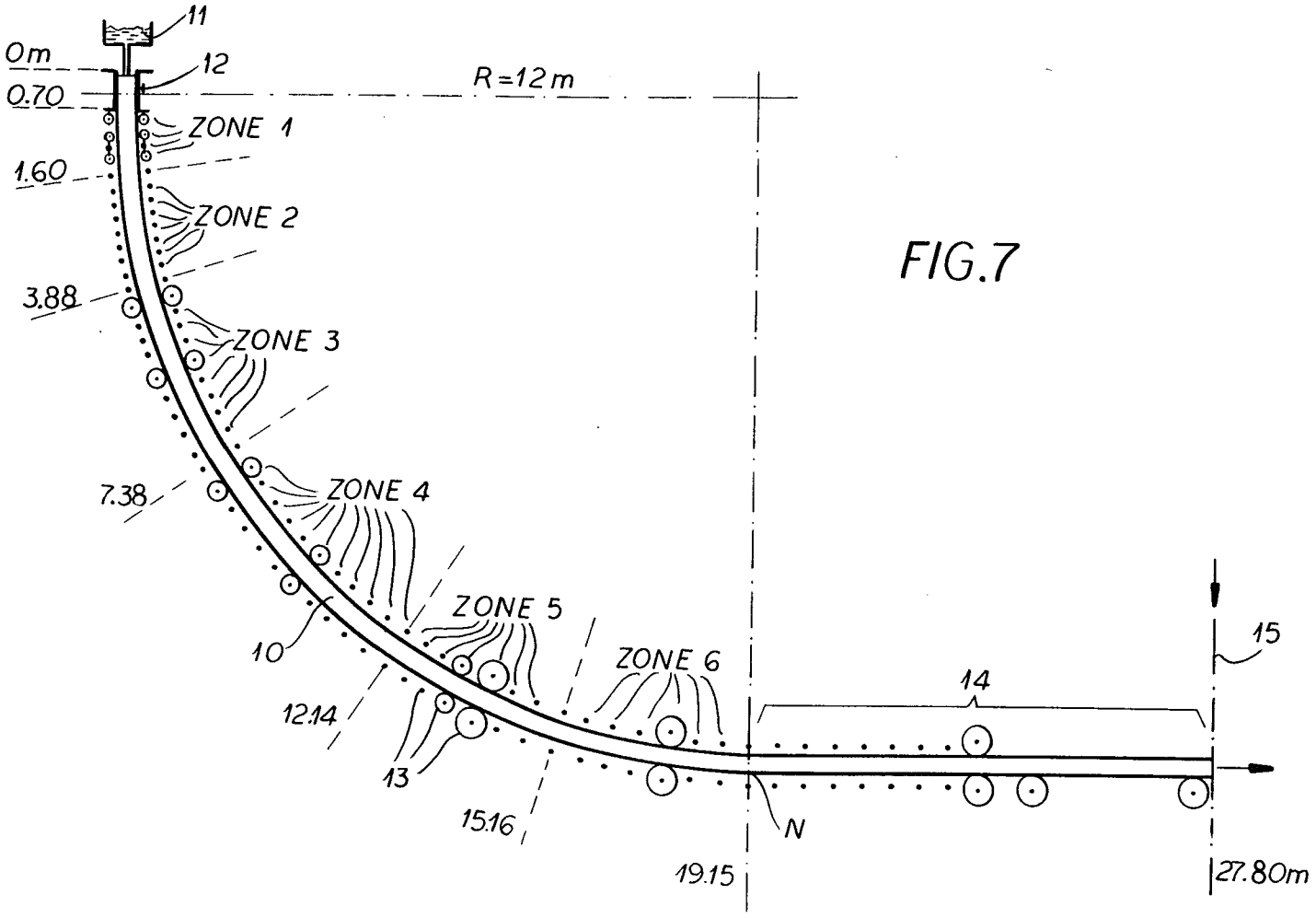
FIG. 7 is a diagrammatic elevational view of part of a continuous-casting machine showing passage of the slab from an ingot mold to a cutting stage.

In FIG. 7 we have shown a steel slab 10 continuously cast at forming stage, comprising a tundish 11 and an ingot mold 12, from which it travels on an arcuate descending path, of radius R=12 meters, through the several secondary-cooling zones 1–6 referred to above; only air cooling is used in the last zone 6. The slab, which may be 1.5 meters wide, is being transported by rollers 13 and enters a straightening stage 14 at the aforementioned point N after moving through 19.15 meters from the tundish. The length of that stage, terminating at a cutting station 15, is 8.65 meters and exceeds that of any cooling zone 1–6; thus, the 30-minute delay between reference time t=0 and the beginning of slowdown at t=30 minutes, amounting to twice the lead time dt shown in FIG. 1, corresponds to the time of travel from tundish 11 to the middle of straightening stage 14 at normal speed $V_a$.

We claim:

1. A process for the control of secondary cooling of elongate workpieces leaving a forming stage of a continuous-casting machine, comprising the steps of:

(a) effecting the cooling by jets of a cooling fluid trained at several cooling zones upon a workpiece traversing same;

(b) modifying the cooling fluid flow in response to variations in the casting speed of the advancing workpiece;

(c) generating a value of a fictitious speed, taking into account expected speed changes due to a foreseeable event, lying between a measured real-time speed and an anticipated speed, and substituting said fictitious speed for said real-time speed in the computation of an average speed at each cooling zone, said anticipated speed being an advance image of a significant variation of future speed expected within a lead time, said cooling fluid flow being modified in step (b) at least in part in response to said computation of said average speed.

2. A process as defined in claim 1 wherein said anticipated speed is calculated with a lead time chosen as a fraction of the travel time of the workpiece along a curved path between said forming stage and a straightening stage to prevent a dropping of the workpiece temperature at said straightening stage below a predetermined threshold.

3. A process as defined in claim 2 wherein said lead time is about half said travel time.

4. A process as defined in claim 3 wherein said workpiece is a steel slab, said threshold being about 900° C., said travel time being on the order of half an hour at a normal casting speed.

5. A process as defined in claim 4 wherein only a descending branch of the expected speed variation is taken into consideration in establishing said anticipated speed.

6. A process as defined in claim 2 wherein said fictitious speed is the arithmetic mean of said real-time and anticipated speeds.

* * * * *